United States Patent [19]

Roussel

[11] Patent Number: 4,700,164

[45] Date of Patent: Oct. 13, 1987

[54] MAGNETIC DEFLECTING YOKE FOR CATHODE-RAY TUBE WITH SHORTENED NECK

[75] Inventor: Bruno Roussel, Genlis, France

[73] Assignee: Videocolor, Montrouge, France

[21] Appl. No.: 877,865

[22] Filed: Jun. 24, 1986

[30] Foreign Application Priority Data

Jun. 27, 1985 [FR] France ..... 85 09823

[51] Int. Cl.[4] ..... H01F 7/00

[52] U.S. Cl. ..... 335/210; 335/213

[58] Field of Search ..... 335/210, 212, 213; 313/421, 426

[56] References Cited

U.S. PATENT DOCUMENTS

| | | | |
|---|---|---|---|
| 2,167,379 | 7/1939 | Tolson | 335/213 |
| 2,845,562 | 7/1958 | Bendell et al. | 335/213 X |
| 3,019,361 | 1/1962 | Di Paolo | 313/76 |
| 3,430,169 | 2/1969 | Gabor | 335/213 |
| 4,369,418 | 1/1983 | Archer | 335/211 |
| 4,409,578 | 10/1983 | Beelaard et al. | 335/210 |

FOREIGN PATENT DOCUMENTS

| | | | |
|---|---|---|---|
| 100219 | 7/1979 | Japan | 335/213 |

OTHER PUBLICATIONS

Patents Abstracts of Japan, vol. 9, No. 110 (E-314) (1833), May 15, 1985; & JP-A 60 1729 (Matsushita Denki Sangyo K.K.) 07-01-1985 *Resume*.

*Primary Examiner*—George Harris

*Attorney, Agent, or Firm*—Oblon, Fisher, Spivak, McClelland & Maier

[57] ABSTRACT

The deflecting yoke for a cathode-ray tube of the invention includes a magnetic circuit enveloping the back flares of the deflecting coils, which are folded down into the extension of the central parts of these coils. The end of the back part of the magnetic circuit extends radially inwards until it substantially makes contact with a neck portion of the cathode-ray tube.

5 Claims, 3 Drawing Figures

MAGNETIC DEFLECTING YOKE FOR CATHODE-RAY TUBE WITH SHORTENED NECK

BACKGROUND OF THE INVENTION

1. Field of the Invention

The present invention relates to a magnetic deflecting yoke for a cathode-ray tube with a shortened neck.

2. Description of the Prior Art

The space taken up by the cathode-ray tube and its deflecting yoke can give rise to difficult problems, especially in professional display systems, for example in avionics. Shortening the neck has been considered as a way to reduce the space factor while keeping the deflection angle constant, but this method has been ruled out until now because it leads to shortening of the available place set aside for the deflecting yoke, which means either that the sensitivity of the deflecting yoke is markedly decreased because the device is shortened or that, if a standard-length deflecting yoke is used, the device sets up magnetic fields which disturb the functioning of the electron gun since the latter is plunged into these fields. This disturbance particularly affects the focusing lens.

SUMMARY OF THE INVENTION

The object of the present invention is a deflecting yoke that can be used in a cathode-ray tube with a shortened neck. The device causes substantially no disturbance in the functioning of the electron gun and is sensitive almost to the optimum degree.

The deflecting yoke according to the invention consists of a magnetic circuit, closed at its back which envelops the so-called rear "flares" (leading-out wires) of the deflector coils, the coils of these deflectors being of the so-called "saddle-saddle" type.

BRIEF DESCRIPTION OF THE INVENTION

The present invention will be better understood from a detailed description of an embodiment taken as a non-exhaustive example and illustrated by the appended drawing, wherein:

FIG. 1 is a longitudinal cross-sectional diagram of a cathode-ray tube of the prior art with its standard deflecting yoke, FIG. 2 is a longitudinal cross-sectional diagram of a cathode-ray tube with a shortened neck, fitted with a deflecting yoke according to the invention, and FIG. 3 is a graph representing the amplitude of the magnetic field deflected horizontally along the longitudinal axis of the cathode-ray tube in FIGS. 1 and 2, within the zone of action of the deflecting yoke of the invention.

DESCRIPTION OF THE PREFERRED EMBODIMENT

Figure 1:
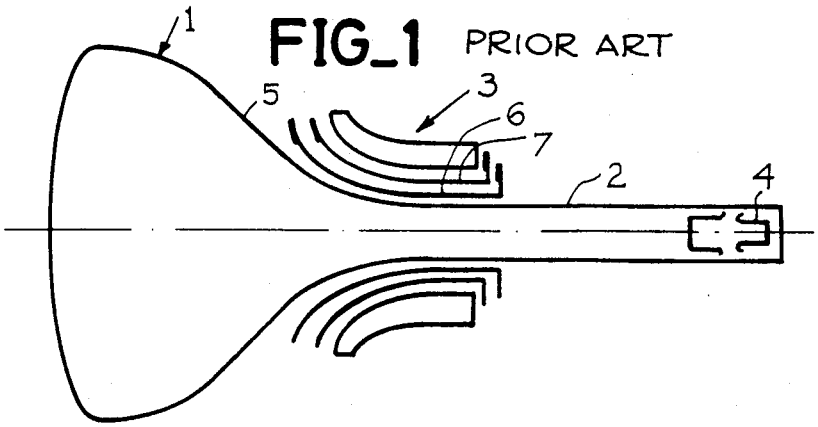
FIG 1 PRIOR ART

The known cathode-ray tube 1, represented in FIG. 1, is of the long-necked type. The length of this neck 2 is such that the magnetic field produced by the deflecting yoke 3 is practically nil at the electron gun 4 of this tube, the deflector being positioned as far as possible from the electron gun, supported on the conical part 5 of the tube. The deflecting yoke 3, according to a standard design, comprises one horizontal deflection coil 6 and another vertical deflection coil 7, both saddle-shaped.

Figure 2:
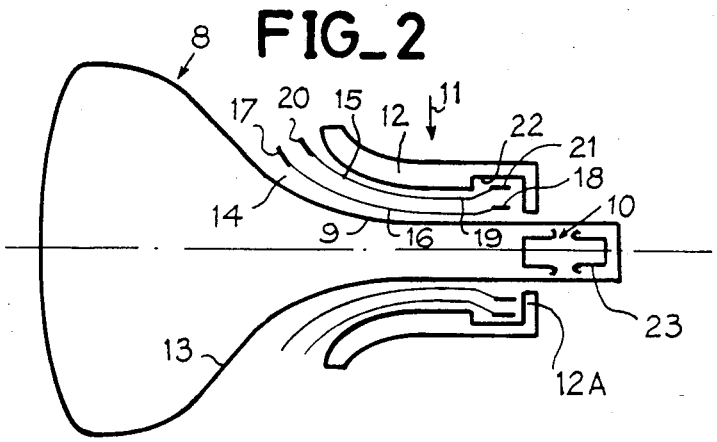

The tube 8, represented in FIG. 2, is of the short-necked type. Its neck 9 is distinctly shorter than the neck 2 of tube 1. This means that if the deflector 3 of the prior art were used, the electron gun 10 of this short-necked tube would be in a zone where the amplitude A of the magnetic field produced by the deflector would not be negligible. Thus, the functioning of the electron gun would be disturbed, as specified above.

To reduce the amplitude of the deflecting yoke's magnetic field at the electron gun so that it becomes negligible, a deflecting yoke according to the invention, such as the device 11 represented in FIG. 2, is used.

The deflecting yoke 11 has a magnetic circuit 12 whose front (from the conical part 13 side of the tube) is widened in the same way as the front of a conventional magnetic circuit. The back of the magnetic circuit 12 is closed, i.e. instead of forming a cylindrical sleeve, the end 12A of this back part extends radially inwards (towards the longitudinal axis of the tube) until it comes substantially into contact with the neck so as to form a back wall that is perpendicular to the tube axis and is provided with an axial hole whose diameter is substantially equal to the external diameter of the neck 9 of the cathode-ray tube.

Furthermore, the deflecting yoke has a horizontal deflection coil 14 and a vertical deflection coil 15. Both these coils are arranged concentrically around the neck 9: for example, the coil 14 is inside coil 15, with the magnetic circuit 12 surrounding them.

The coil 14, which very precisely fits the shape of the tube (the neck and the beginning of the conical part 13), has a central part 16 and flares 17 (in front) and 18 (in the rear). The flare 18, instead of being folded radially outwards, is distinctly within the extension of the central part 16. Similarly, the coil 15 has a central part 19 and flares 20 (in front) and 21 (in the rear), with the flare 21 distinctly in the extension of the central part 19 above the flare 18. In front and in their central part, the coils 14 and 15 have substantially the same saddle shape as the coils 6 and 7. The magnetic circuit 12, which should fit the external outline of the coil 15, thus has a slight recess 22, just in front of the end wall 12A, in order to house the flares 18 and 21 which are thicker than the central parts 16 and 19. Thus the magnetic circuit 12 "envelops" the flares 18 and 21.

When a short-necked tube such as tube 18 is used, the focusing lens 13 is very close to the deflecting yoke. If a deflecting yoke such as the conventional deflecting yoke 3 in FIG. 1 were to be used, the amplitude of its magnetic field (represented by the continuous line curve in FIG. 3) at the lens 23 (zone 24 in FIG. 3) would still be high enough to deflect the electronic beam produced by the gun and hence the shift its axis in relation to the lens 23, whence the appearance of spherical aberrations caused by this lens at the focused spot. For, at this lens 23, the electronic beam of the gun 10 reaches its maximum diameter, and it has a low potential in comparison with its final potential when it leaves the gun; this beam is therefore, very sensitive to magnetic fields.

Figure 3:
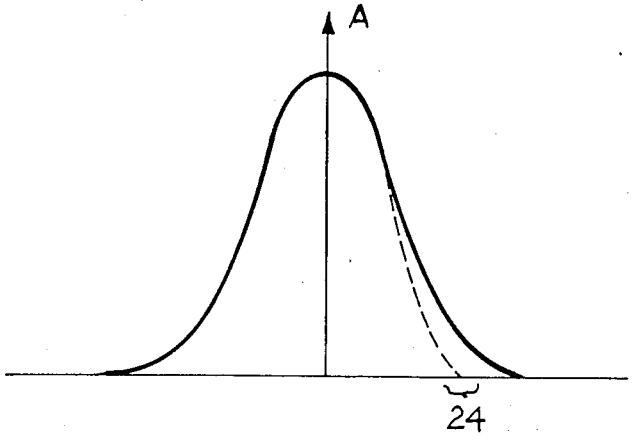

By using a deflector according to the invention, wherein the magnetic circuit is made of a ferromagnetic material, for example, mumetal or ferrite with a high degree of permeability (far greater than 1) and a low time constant (about a few microseconds) in setting up the field, very sharp attenuation is obtained of the magnetic field behind the deflecting yoke, as illustrated by the discontinuous line curve in FIG. 3. Thus, the magnetic field becomes negligible at the focusing lens (zone 24 in FIG. 3) the coil 17 being, in its front part, identical to the conventional coil 6. The left-hand side of the curve is identical with the other curve. We thus get similar curves for the vertical deflection.

The end of the back part of the magnetic circuit extends radially inwards until it substantially makes contact with a neck portion of the cathode-ray tube.

Obviously, numerous modifications and variations of the present invention are possible in light of the above teachings. It is therefore to be understood that within the scope of the appended claims, the invention may be practiced otherwise than as specifically described herein.

I claim:

1. A magnetic deflecting yoke for a cathode-ray tube with a shortened neck, deflection coils of said deflecting yoke being of a "saddle-saddle" type, wherein said yoke comprises a plurality of deflecting yoke coils having rear flares and a magnetic circuit closed at a back portion thereof which envelops said rear flares of said deflecting yoke coils and wherein an end portion of said back portion of the magnetic circuit extends radially inwards, until substantially making contact with said neck.

2. A deflecting yoke according to claim 1, wherein said rear flares of said coils extend along a extension of central portions of said coils.

3. A deflecting yoke, according to claim 2, wherein said back flares are superimposed.

4. A deflecting yoke, according to claim 1, wherein the magnetic circuit fits an outline of the external coil and wherein said magnetic circuit includes a recess formed at said back portion to house said back flares of said coils.

5. A deflecting yoke, according to claim 1, wherein the magnetic circuit comprises a ferromagnetic material such as mumetal with a high degree of magnetic permeability.

* * * * *